US006947568B2

(12) United States Patent
Tanabe et al.

(10) Patent No.: US 6,947,568 B2
(45) Date of Patent: Sep. 20, 2005

(54) CONDENSER MICROPHONE

(75) Inventors: Haruhisa Tanabe, Yamanashi-ken (JP); Megumi Horiuchi, Yamanashi-ken (JP)

(73) Assignee: Citizen Electronics Co., Ltd., Yamanashi-ken (JP)

( * ) Notice: Subject to any disclaimer, the term of this patent is extended or adjusted under 35 U.S.C. 154(b) by 0 days.

(21) Appl. No.: 10/668,221

(22) Filed: Sep. 24, 2003

(65) Prior Publication Data

US 2004/0057595 A1 Mar. 25, 2004

Related U.S. Application Data

(62) Division of application No. 10/141,817, filed on May 10, 2002, now Pat. No. 6,708,387.

(30) Foreign Application Priority Data

May 15, 2001 (JP) ..... 2001-145694

(51) Int. Cl.[7] ..... H04R 25/00

(52) U.S. Cl. ..... 381/174; 29/414; 29/417; 29/602.1; 29/609.9; 29/594; 29/25.41; 367/180; 367/178; 381/174; 381/175; 381/190; 381/191

(58) Field of Search ..... 29/594, 414, 25.41, 29/602.1, 609.1, 417; 367/178, 180; 381/174, 191, 175, 190

(56) References Cited

U.S. PATENT DOCUMENTS

| | | | | | |
|---|---|---|---|---|---|
| 3,118,022 | A | * | 1/1964 | Sessler et al. | 381/191 |
| 3,736,552 | A | * | 5/1973 | Seesler et al. | 367/7 |
| 3,942,029 | A | * | 3/1976 | Kawakami et al. | 307/400 |
| 5,798,460 | A | * | 8/1998 | Nakagawa et al. | 73/654 |

FOREIGN PATENT DOCUMENTS

| | | |
|---|---|---|
| CN | 1290998 | 4/2001 |
| JP | 2001-069596 | 3/2001 |

* cited by examiner

*Primary Examiner*—A. Dexter Tugbang
*Assistant Examiner*—Tai Van Nguyen
(74) *Attorney, Agent, or Firm*—Dennison, Schultz, Dougherty & MacDonald

(57) ABSTRACT

A back plate having a stationary back electrode is secured to a substrate. A diaphragm electrode is mounted on the back plate interposing a spacer. A frame having a sound collecting hole is mounted on the diaphragm electrode.

3 Claims, 4 Drawing Sheets

28
23
17
28a
23
28a
29
29a
29a
25
16
23
16
22
23
23
13

CONDENSER MICROPHONE

This application is a division of Ser. No. 10/141,817, filed May 10, 2002, now U.S. Pat. No. 6,708,387.

BACKGROUND OF THE INVENTION

The present invention relates to a condenser microphone and a method for manufacturing condenser microphones for a portable telephone, video camera and others.

FIG. 5 shows a sectional view of a conventional condenser microphone. The condenser microphone comprises a substrate 2, a field-effect transistor (FET) 3 mounted on the substrate 2, a back plate 5 mounted on the substrate 2 interposing a spacer 4, and a frame 8 mounted on the back plate 5 interposing a spacer 6. A diaphragm 7 as a movable electrode is secured to the underside of the frame, and a stationary electrode (not shown) is secured to the surface of the back plate 5.

When assembling the microphone, bottom portion 1*a* of a case 1 is not bent. The case 1 having a sound collecting hole 1*b* is inverted and the above described elements are mounted in the case 1. Then, the bottom portion 1*a* is bent as shown in FIG. 5.

In the conventional condenser, composition elements must be packaged in the case at every microphone and the bottom portion 1*a* must be bent.

Therefore, the productivity of the condenser microphone is low, the manufacturing cost high.

SUMMARY OF THE INVENTION

An object of the present invention is to provide a condenser microphone which may be simply manufactured at a low cost.

Another object of the present invention is to provide a method by which a plurality of condenser microphone can be manufactured at a low cost.

According to the present invention, there is provided a condenser microphone comprising a substrate, a back plate having a stationary back electrode and secured to the substrate, a spacer mounted on the back plate, a diaphragm electrode on the spacer; and a frame having a sound collecting hole and mounted on the diaphragm electrode.

A recess in which wirings connecting the stationary back electrode, diaphragm electrode and circuits on the substrate is provided on a side of the microphone.

The present invention further provides a method for manufacturing condenser microphones comprising the steps of preparing a substrate aggregation having a plurality of divisions, and a substrate being provided in each of the divisions, preparing a back plate aggregation having a stationary back electrode at each division, preparing a spacer aggregation having an opening at each division, preparing a frame aggregation having a sound collecting hole at each division and a diaphragm electrode on the underside of the frame aggregation around the sound collecting hole, stacking said aggregations and adhering the aggregations to each other to form an assembly of aggregations, cutting the assembly of aggregations to separate a condenser microphone at each division.

The substrate aggregation, back plate aggregation and frame aggregation are made of ceramic.

The stationary back electrode is formed by printing a metal paste.

The diaphragm electrode is formed by vacuum deposition of metal.

These and other objects and features of the present invention will become more apparent from the following detailed description with reference to the accompanying drawings.

DETAILED DESCRIPTION OF THE PREFERRED EMBODIMENT

Figure 3:
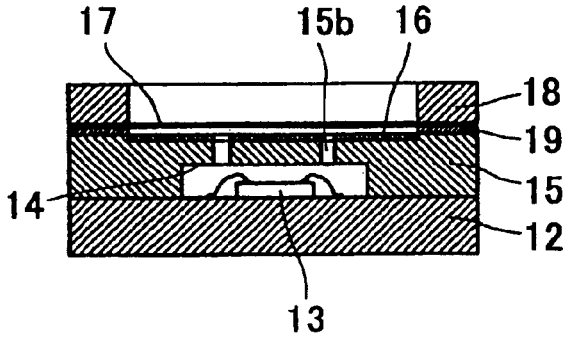
FIG. 3 is a sectional view of a condenser microphone according to the present invention.
Figure 4:
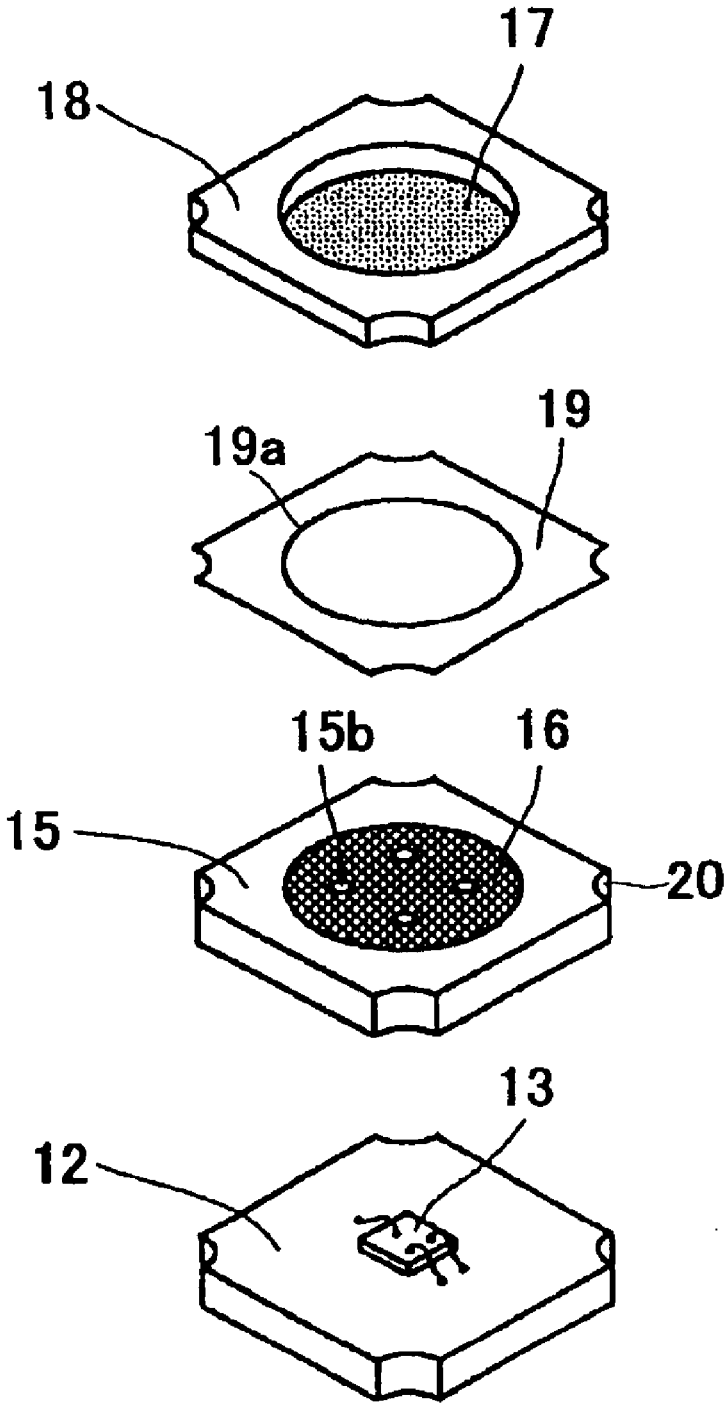
FIG. 4 is an exploded perspective view of the condenser microphone.
Figure 5:
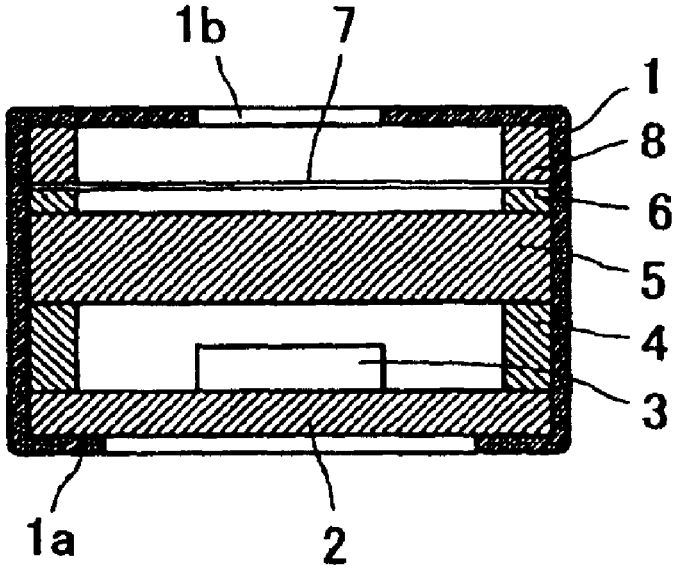
FIG. 5 PRIOR ART
FIG. 5 is a sectional view showing a conventional condenser microphone.

Referring to FIGS. 3 and 4, the condenser microphone according to the present invention is characterized in that composition elements are assembled without casing.

The condenser microphone comprises a substrate 12 having printed circuits, a field-effect transistor (FET) 13 securely mounted on the substrate 12, a back plate 15 having a recess 14 for the FET 13 and vents 15*b* and secured to the substrate 12, a stationary back electrode 16 securely mounted on the surface of the back plate 15, and a frame 18 mounted on the back plate 5 interposing a spacer 19 having an opening 19*a*. The substrate 12, back plate 15, frame 18 are made of ceramic. A diaphragm electrode 17 as a movable electrode is secured to the underside of the frame 18. The stationary back electrode 16 and the diaphragm electrode 17 form a condenser.

As shown in FIG. 4, semicircular recesses 20 are provided at four corners of the microphone, in which wirings for connecting electrodes 16, 17, circuits on the substrate 12 and others are printed.

The manufacturing method of the present invention will be described hereinafter.

Referring to FIGS. 1*a*–1*d*, respective raw material plates have the same size which is the size of aggregation of 12 pieces of the microphone. Hence, each plate is divided into 12 divisions. Each division has a square.

Figures 1A, 1B, 1C, 1D:
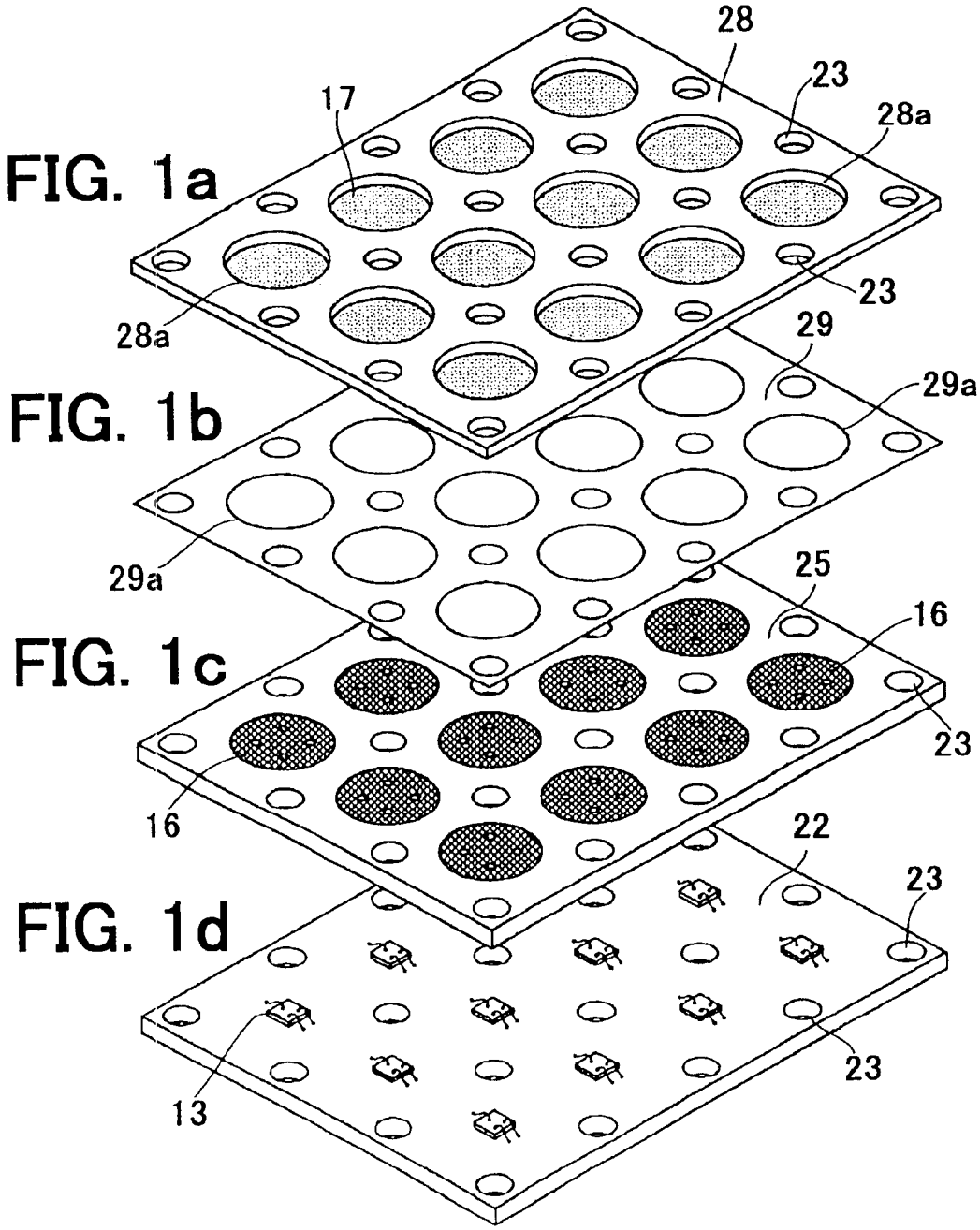
FIGS. 1*a* through 1*d* are perspective views showing materials for assembling condenser microphones.

A substrate aggregation 22 of FIG. 1*d* has a substrate in each division. The FET 13 is secured at a central position of each division and connected to a circuit on each substrate by the wire bonding. Furthermore, the FET is coated with a plastic protective film. In each division of a back plate aggregation 25, the recess 14 and vents 15*b* shown in FIG. 3 are formed. A metal paste is printed on the surface of the back plate aggregation 25 to form the stationary back electrode 16 in each division.

A spacer aggregation 29 made of metal sheet has an opening 29*a* at each division.

A frame aggregation 28 has a sound collecting hole 28*a* at each division. On the underside of the frame aggregation 28, a diaphragm electrode film is formed around the sound collecting hole by vacuum deposition of metal and shaped into the diaphragm electrode 17.

In each aggregation, four small holes 23 are formed at four corners of each division for the recess 20.

Figure 2:
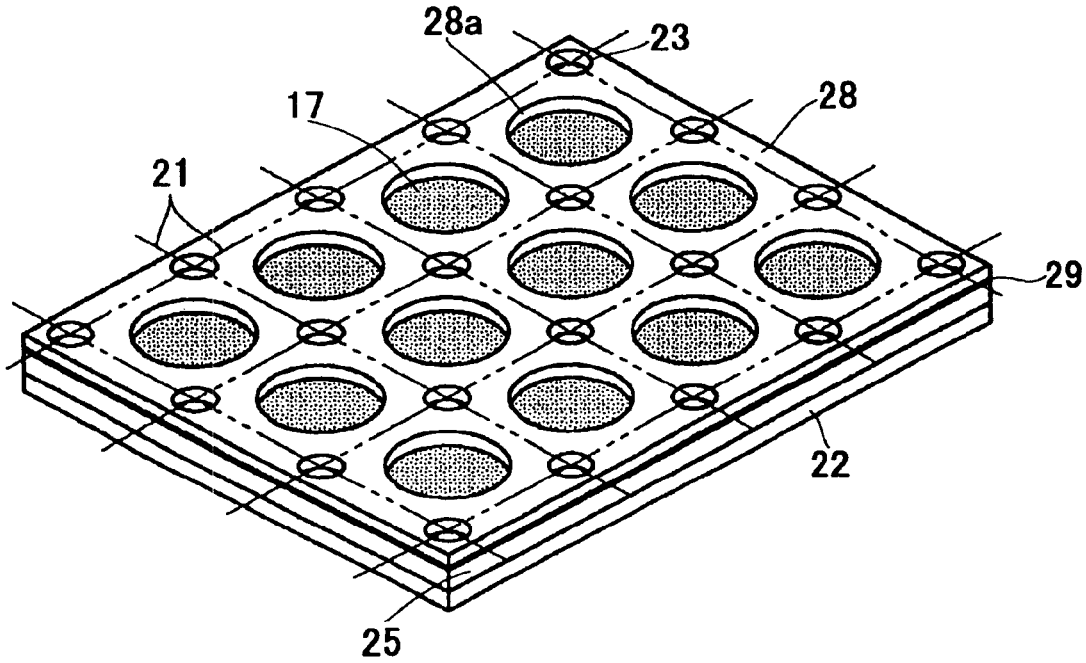
FIG. 2 is a perspective view showing a combined material.

All aggregations 22, 25, 29 and 28 are stack in the order of FIGS. 1*a*–1*d* and adhered to each other with adhesive to provide an assembly of aggregations as shown in FIG. 2. The assembled aggregation plate is cut along grid lines 21 to produce 12 pieces of the condenser microphone.

Each small hole 23 is divided into four semicircular recesses 20.

In accordance with the present invention, composition elements of the condenser microphone are assembled without casing. The microphone can be easily manufactured at a low cost.

While the invention has been described in conjunction with preferred specific embodiment thereof, it will be understood that this description is intended to illustrate and not limit the scope of the invention, which is defined by the following claims.

What is claimed is:

1. A condenser microphone comprising:

a substrate;

a back plate having a stationary back electrode and secured to the substrate;

a spacer securely mounted on the back plate;

a diaphragm electrode secured to an upper surface of the spacer;

a frame having a sound collecting hole and securely mounted on the diaphragm electrode; and at least one corner recess including means for making an electrical connection to the microphone.

2. A condenser microphone comprising:

a substrate;

a back plate having a stationary back electrode and secured to the substrate;

a spacer securely mounted on the back plate;

a diaphragm electrode secured to an upper surface of the spacer;

a frame having a sound collecting hole and securely mounted on the diaphragm electrode;

a field-effect transistor mounted on the substrate in a recess in the back plate; and at least one vent through the back plate to the recess.

3. A condenser microphone comprising:

a substrate;

a back plate having a stationary back electrode and secured to the substrate;

a spacer securely mounted on the back plate;

a diaphragm electrode secured to an upper surface of the spacer; and a frame having a sound collecting hole and securely mounted on the diaphragm electrode, thereby forming the condenser microphone case-free.

* * * * *